United States Patent [19]

Parsons

[11] 4,248,939

[45] Feb. 3, 1981

[54] PROCESS FOR DOUBLE COATING PAPER AND PRODUCT THEREOF

[75] Inventor: Charles L. Parsons, Port Orchard, Wash.

[73] Assignee: Hercules Incorporated, Wilmington, Del.

[21] Appl. No.: 84,285

[22] Filed: Oct. 12, 1979

Related U.S. Application Data

[63] Continuation of Ser. No. 962,430, Nov. 20, 1978, abandoned.

[51] Int. Cl.[3] ..... B05D 1/36; B32B 29/04; B32B 19/02; B32B 27/04

[52] U.S. Cl. ..... 428/508; 427/411; 428/448; 428/510; 428/511; 428/514

[58] Field of Search ..... 427/411; 428/448, 508, 428/510, 511, 514

[56] References Cited

U.S. PATENT DOCUMENTS

| | | | |
|---|---|---|---|
| 3,053,676 | 9/1962 | Higbee | 106/148 |
| 3,364,186 | 1/1968 | Wilhelm et al. | 260/80.72 |
| 3,637,432 | 1/1972 | Gibbs et al. | 260/29.6 TA |
| 3,637,565 | 1/1972 | Sheets | 260/29.6 TA |
| 3,775,353 | 11/1973 | Kohne et al. | 260/2.5 B |
| 3,779,800 | 12/1973 | Heiser | 260/8 |
| 3,819,557 | 6/1974 | Loeffler | 260/29.6 TA |
| 3,824,114 | 7/1974 | Vassiliades et al. | 252/316 |
| 3,853,579 | 12/1974 | Heiser | 428/421 |
| 3,914,196 | 10/1975 | Loeffler | 260/29.7 H |

OTHER PUBLICATIONS

Abstract of Japanese Pat. No. 7338005, November 1973.
Abstract of Japanese Pat. No. 74021252, May 1974.
Abstract of German Pat. No. 2429029, January 1975.
Abstract of Belgian Pat. No. 822238, May 1975.
Abstract of Japanese Pat. No. 9080307, August 1974.

*Primary Examiner*—James R. Hoffman

[57] ABSTRACT

This invention relates to organic pigment-containing paper coating systems which require less severe calendering conditions to develop the surface and optical properties of paper than coating systems using inorganic pigments alone. It comprises overcoating a pre-applied mineral based coating with an organic pigment based coating.

26 Claims, No Drawings

PROCESS FOR DOUBLE COATING PAPER AND PRODUCT THEREOF

This is a continuation of application Ser. No. 962,430, filed Nov. 20, 1978, now abandoned.

Paper and other cellulosic substrates are often coated to improve appearance and printability. The coatings usually comprise an inorganic pigment such as clay, calcium carbonate or titanium dioxide with a binder which holds the pigment particles together as well as binding them to the substrate. The applied coating provides a smooth, ink-receptive surface suitable for printing. In addition, the inorganic pigment particles scatter light, opacify and brighten the coated substrate.

Recently, polymer particles, such as finely divided particles of polystyrene, have been used as replacements or partial replacements for inorganic pigments in paper coatings. These polymer particles are referred to in the art as "organic pigments".

The invention described herein relates to organic pigment-containing paper coating systems which require less severe calendering conditions to develop the surface and optical properties of paper than coating systems using inorganic pigments alone. It comprises overcoating a pre-applied mineral based coating with an organic pigment based coating.

The organic pigments used in the topcoat can be prepared by graft copolymerizing, in aqueous media, a monoethylenically unsaturated monomer, to be detailed hereafter, onto a water-soluble prepolymer. More specifically, an aqueous solution of the water-soluble prepolymer is first prepared. The prepolymers can be homopolymers or copolymers of two or more monomers. To the aqueous solution of the prepolymer are added a free-radical polymerization initiator and the desired monoethylenically unsaturated monomer and free radical graft copolymerization is carried out at a temperature of from about 40° C. to about 90° C. The exact temperature employed depends on the initiator and the monomer employed. A highly stable latex is produced. In some instances, the water can be removed, if desired, as by drying, to provide free-flowing graft copolymer particles.

The water-soluble prepolymers used in this invention can be anionic polymers prepared by the addition polymerization of vinyl monomers, at least one of which is anionic, and mixtures thereof and are well known in the art of water-soluble addition-type polymers. Monomers that can be used to prepare anionic prepolymers are alpha, beta-ethylenically unsaturated mono- and polycarboxylic acids such as acrylic acid, methacrylic acid, itaconic acid, maleic acid, and fumaric acid. Other suitable monomers that can be used to prepare anionic prepolymers are vinyl sulfonic acid, allyl sulfonic acid, styrene sulfonic acid, and 2-sulfoethylmethacrylate. The anionic monomers may be copolymerized with alpha, beta-ethylenically unsaturated amides such as acrylamide, methacrylamide, N,N-dimethylacrylamide, N-methylacrylamide, N-methylolacrylamide and diacetone acrylamide. Other suitable comonomers are hydroxyethyl acrylate, hydroxypropyl acrylate, hydroxyethyl methacrylate, hydroxypropyl methacrylate and N-vinylpyrrolidone. Copolymers of vinyl alcohol and acrylic acid or methacrylic acid are also suitable and may be prepared by hydrolyzing a copolymer of vinyl acetate and acrylic acid or methacrylic acid.

Examples of anionic prepolymers are copolymers of acrylamide and acrylic acid; copolymers of methacrylamide and acrylic acid; copolymers of acrylamide and methacrylic acid; and copolymers of methacrylamide and methacrylic acid. As is evident to those skilled in the art, these prepolymers are only anionic in their neutralized form.

Cationic water-soluble prepolymers can also be used in the preparation of the organic pigments of this invention. Particularly suitable are cationic water-soluble prepolymers which are addition type copolymers prepared from about 5 mole percent to about 95 mole percent of at least one ethylenically unsaturated cationic monomers having the formulas (I), (II), (III), (IV), (V) and (VI) below and about 95 mole percent to about 5 mole percent of at least one ethylenically unsaturated nonionic monomer.

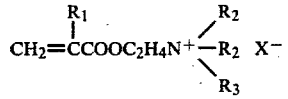

(I)

In formula (I), $R_1$ is hydrogen or methyl; $R_2$ is hydrogen or a $C_1$–$C_4$ alkyl such as methyl, ethyl, propyl, or butyl; $R_3$ is hydrogen, a $C_1$–$C_4$ alkyl,

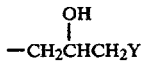

where Y is hydroxyl or halogen such as chlorine and bromine,

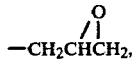

and $(CH_2CH_2O)_nH$ where n is an integer 1 or more, preferably 1 through 20; and $X^-$ is an anion such as $Cl^-$, $Br^-$, $CH_3OSO_3^-$ and $CH_3COO^-$. Monomers of formula (I) are quaternary ammonium salts and acid salts or amino acrylates such as dimethylaminoethylacrylate, diethylaminoethylacrylate, dimethylaminoethylmethacrylate, and diethylaminoethylmethacrylate. Specific quaternary salt monomers having the formula (I) are methacryloyloxyethyltrimethylammonium methyl sulfate and methacryloyloxyethyltrimethylammonium chloride. Specific acid salt monomers having the formula (I) are methacryloyloxyethyldimethylammonium chloride and methacryloyloxyethyldimethylammonium acetate.

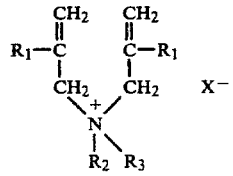

(II)

In formula (II), $R_1$ is hydrogen or a $C_1$–$C_4$ alkyl. $R_2$ is hydrogen, alkyl or substituted alkyl. Typical alkyl groups, which $R_2$ can be, contain from 1 through 18 carbon atoms, preferably from 1 through 6, and include methyl, ethyl, propyl, isopropyl, t-butyl, hexyl, octyl, decyl, dodecyl, tetradecyl, and octadecyl. $R_2$ can also be a substituted alkyl, suitable substituents being any substituent that will not interfere with polymerization through a vinyl double bond. Typically the substituents can be carboxylate, cyano, ether, amino (primary, secondary or tertiary), amide, hydrazide and hydroxyl. $R_3$ and $X^-$ are as defined in formula (I). The formula (II) monomers are quaternary ammonium salts and acid salts of a diallylamine having the formula

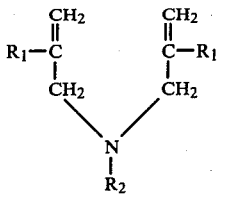

where $R_1$ and $R_2$ are as above defined. Specific examples of quaternary ammonium salt monomers having formula (II) are dimethyldiallylammonium chloride and dimethyldiallylammonium bromide. Specific examples of acid salt monomers having formula (II) are methyldiallylammonium acetate, diallylammonium chloride, N-methyldiallylammonium bromide, 2,2'-dimethyl-N-methyldiallylammonium chloride, N-ethyldiallylammonium bromide, N-isopropyldiallylammonium chloride, N-n-butyldiallylammonium bromide, N-tertbutyldiallylammonium chloride, N-n-hexyldiallylammonium chloride, N-octadecyldiallylammonium chloride, N-acetamidodiallylammonium chloride, N-cyanomethyldiallylammonium chloride, N-β-propionamidodiallylammonium bromide, N-acetic ethyl ester substituted diallylammonium chloride, N-ethylmethylether substituted diallylammonium bromide, N-β-ethylaminediallylammonium chloride, N-hydroxyethyldiallylammonium bromide and N-aceto-hydrazide substituted diallylammonium chloride.

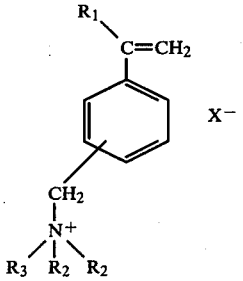

(III)

In formula (III), $R_1$, $R_2$, $R_3$ and $X^-$ are as defined in formula (I). Specific examples of monomers of formula (III) are vinylbenzyltrimethylammonium chloride and vinylbenzyltrimethylammonium bromide.

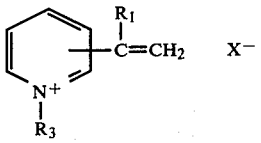

(IV)

In formula (IV), $R_1$, $R_3$ and $X^-$ are as defined in formula (I). Specific examples of monomers of formula (IV) are 2-vinylpyridinium chloride and 2-vinylpyridinium bromide.

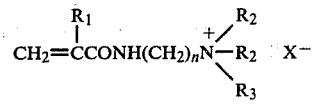

(V)

In formula (V), $R_1$, $R_2$, $R_3$ and $X^-$ are as defined in formula (I), and n is an integer 1, 2 or 3. A specific example of a monomer of formula (V) is methacrylamidopropyldimethylammonium chloride.

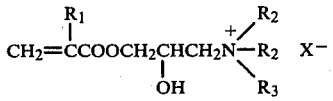

(VI)

In formula (VI), $R_1$, $R_2$, $R_3$ and $X^-$ are as defined in formula (I). A specific example of a monomer of formula (VI) is 3-methacryloyloxy-2-hydroxypropyldimethylammonium chloride.

The ethylenically unsaturated nonionic monomers useful as comonomers with the above cationic monomers include N-vinyl pyrrolidone, ethylenically unsaturated monomers having amide functionality, and ethylenically unsaturated monomers having hydroxyl functionality. One particularly preferred nonionic comonomer is acrylamide.

Examples of cationic prepolymers are copolymers of acrylamide and methyldiallylamine hydrochloride; acrylamide and dimethyldiallylammonium chloride; and terpolymers of acrylamide, methyldiallylamine hydrochloride, and dimethyldiallylammonium chloride.

Nonionic prepolymers may be used in the preparation of the organic pigments used in this invention. They can be prepared by the addition polymerization of vinyl monomers and mixtures thereof and are well known in the art of water-soluble addition-type polymers. Examples of nonionic monomers are alpha, beta-ethylenically unsaturated amides such as acrylamide, methacrylamide, N-N-dimethylacrylamide, N-methylacrylamide, N-methylolacrylamide, and diacetoneacrylamide. Other suitable nonionic monomers are hydroxyethyl acrylate, hydroxypropyl acrylate, hydroxyethyl methacrylate, hydroxypropyl methacrylate and N-vinylpyrrolidone.

Nonionic prepolymers include homopolymers and copolymers of the above monomers such, for example, as polyacrylamide, the homopolymer of acrylamide; polymethacrylamide, the homopolymer of methacrylamide; a copolymer of acrylamide and hydroxyethyl acrylate; a copolymer of methacrylamide and hydroxypropyl acrylate; and a copolymer of acrylamide and hydroxyethyl methacrylate. Another suitable water-soluble polymer that can be used is poly(vinyl alcohol).

Other suitable water-soluble polymers are the naturally occurring polymers such as starch (nonionic); the nonionic and anionic derivatives of starch; and those naturally occurring polymers made water-soluble by derivatization such as hydroxyethyl cellulose (nonionic) and the sodium salt of carboxymethyl cellulose (anionic).

Water-soluble anionic, cationic or nonionic prepolymers are easily and readily prepared by adding, simultaneously, the desired monomers, in the desired amounts, and a water-soluble, free-radical polymerization initiator, each in aqueous solution, to a reaction vessel containing water maintained at a temperature of about 80°

C. to about 90° C. Suitable free-radical polymerization initiators are those employed in preparing the graft copolymer particles used in this invention and are set forth hereinafter. The amount of initiator employed will be that amount sufficient to provide water-soluble prepolymers having an RSV (reduced specific viscosity) of from about 0.1 to about 2.5, preferably from about 0.1 to about 1, measured as a 1% solution in 1 M Nacl at 25° C.,) or an RSV of from about 0.1 to about 2.5, preferably from about 0.15 to about 1 measured as a 1% solution in 0.1 M NaCl at 25° C., (0.1 M NaCl, 1%, 25° C.).

There are two main requirements for the graft copolymer particles used in accordance with this invention. They must be (1) water-insoluble and (2) have a high enough melting or softening point that they will not be deformed to any substantial degree under the conditions of heat or pressure or both to which they will be subjected during coating. All the graft copolymers prepared in the working examples that follow have a second order transition temperature (glass transition temperature, $T_g$) greater than 70° C. Preferably, the graft copolymers will have a Tg greater than 75° C.

Any monomer that will graft copolymerize with the water-soluble anionic or cationic prepolymers to provide graft copolymer particles meeting the above requirements can be employed in the organic pigments of this invention. Suitable monomers are monoethylenically unsaturated monomers such, for example, as acrylic esters such as methyl alpha-chloroacrylate and ethyl alpha-chloroacrylate; methacrylic esters such as methylmethacrylate, isopropylmethacrylate, and phenylmethacrylate; monomers having the formula:

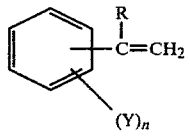

where R is hydrogen or methyl, Y is methyl or chlorine and n is 0, 1, 2, or 3. Examples of such monomers are styrene, alphamethylstyrene, monochlorostyrene, dichlorostyrene, trichlorostyrene, monomethylstyrene, dimethylstyrene, trimethylstyrene and alpha-methyl p-methyl styrene. Other suitable monomers are vinyl chloride, acrylonitrile, and methacrylonitrile.

Mixtures of two or more monoethylenically unsaturated monomers can be used providing the resulting graft copolymer particles are water-insoluble and have a $T_g$ of about 75° C. or greater.

Of the above listed monoethylenically unsaturated monomers, styrene, vinyl chloride, acrylonitrile, and methyl methacrylate are preferred.

As previously stated, the graft copolymers used in this invention must have a melting or softening point high enough that they will not be deformed under the conditions of heat or pressure or both to which they are subjected during the coating process. In some cases it is desirable to crosslink the graft polymer to increase its resistance to the heat and pressure exerted on the particles during coating. Polyethylenically unsaturated monomers can be used in admixture with the above described monoethylenically unsaturated monomers to provide the desired crosslinking. Examples of suitable polyethylenically unsaturated monomers are diallyl phthalate, diallyl maleate, diallyl fumarate, ethylene glycol dimethacrylate, 1,3-butylene glycol dimethacrylate, 1,6-hexanediol dimethacrylate, polyethylene glycol dimethacrylate, and polypropylene glycol dimethacrylate, trimethylolpropane trimethacrylate, pentaerythritol tetraacrylate, divinylbenzene, trivinylbenzene and divinylnaphthalene. The preferred crosslinking monomers are divinylbenzene, diallyl phthalate, ethylene glycol dimethacrylate and 1,3-butylene glycol dimethacrylate. Mixtures of polyethylenically unsaturated monomers may also be used.

The amount of water-soluble prepolymer used in preparing the graft copolymers used as organic pigments in this invention can vary from about 1 part to about 25 parts based on about 100 parts of monomer or monomer mixture. The preferred range is from about 2 to about 10 parts per 100 parts of monomer or monomer mixture.

As set forth above, graft copolymerization is carried out by adding the graft copolymerizable monomer to a solution of water-soluble prepolymers in the presence of a polymerization initiator. The prepolymer can be present in the reaction vessel initially, or it can be added simultaneously with monomers. The polymerization initiator is usually added continuously along with the monomer.

A wide variety of chemical polymerization initiators can be used to prepare the latexes used in this invention, with peroxy compounds being particularly useful. The initial stage of polymerization involves formation of a graft copolymer between the monomer and the water-soluble prepolymer. The initiator presumably first introduces free-radical sites onto the prepolymer. Addition of monomer to these sites then leads to the desired graft copolymer particles.

Suitable water-soluble initiators include those activated by heat, such as sodium persulfate and ammonium persulfate. Polymerizations carried out with these initiators are generally run at temperatures of 70°–95° C. Other water-soluble initiators that are suitable include the so-called redox initiator systems such as ammonium persulfate-sodium bisulfite-ferrous ion and t-butyl hydroperoxide-sodium formaldehyde sulfoxylate. Redox initiators are activated at relatively low temperatures, and polymerizations employing these systems can be carried out at temperatures from about 20° C. to about 80° C.

The amount of initiator employed is within the skill of the art. Usually, about 0.1 part to about 5 parts of initiator will be employed for each 100 parts of monomer used.

In some cases it is desirable that the prepolymer moiety of the graft copolymer particles contain a group that is reactive. Such reactivity will usually increase the bonding properties of the particles to one another and to the surface to which they are applied.

Reactive groups can be reintroduced into some monomers containing incompletely substituted amide groups or hydroxyl groups prior to preparation of the prepolymer, they can be introduced into amide containing prepolymers after preparation thereof, or they can be introduced into the graft copolymer particles after preparation thereof.

Reactive groups can be introduced by means of an aldehyde such as formaldehyde, glyoxal, and gluteraldehyde with monomers containing amide functionality such as acrylamide. Using dialdehydes, such as glyoxal, the reactive group will be an aldehyde or an acetal. Using formaldehyde, the reactive group will be the N-methylol group.

Monomers containing hydroxyl functionality can have reactive groups introduced by means of dialdehydes, such as glyoxal or gluteraldehyde. Also, reactie groups can be introduced by means of reaction of epihalohydrins with monomers containing amine functionality.

The amount of functionalizing agent employed to provide reactive groups on the graft copolymer particles will be about 0.25 mol to about 3 mols, preferably about 1 mol to about 2 mols, for each mol of amide, hydroxyl or amine functionality. Reaction will be carried out at a temperature from about 20° C. to about 60° C. at a pH of about 8 to about 10 except when formaldehyde is used as the aldehyde, reaction is carried out at a pH from about 2 to about 3.

According to the invention, the organic pigments described above are applied as an overcoat to paper which has previously been coated with a conventional inorganic pigment. Any suitable coating method may be used, such as coating with a Meyer rod or Time-Life coater.

In general, the inorganic base coat contains a mineral pigment such as clay, calcium carbonate, silica, or titanium dioxide, a thickener, and in most cases a binder. Generally, the thickener is present in amounts of about 0 to about 1 part and the binder in amounts from about 5 to about 30 parts per 100 parts of pigments. Preferred materials are kaolin clay as pigment, carboxymethyl cellulose as thickener and polyvinyl acetate, butadiene-styrene copolymer rubber latex or starch as binder.

The organic pigment overcoat compositions of this invention contain from about 5 to about 30 parts binder and about 0 to about 1 part thickener per 100 parts of organic pigment. The preferred binders are polyvinyl acetate, butadiene-styrene copolymer rubber latex or starch; the preferred thickener is carboxymethyl cellulose.

Once coated, the paper is calendered to develop gloss. It is understood that the calendering conditions, i.e., roller temperature and pressure, may be varied, depending upon the particular overcoat composition used and the degree of gloss desired. In general, the calendering conditions may range from about 60° C. to about 110° C. and 100 pounds per linear inch (pli) to about 2500 pli.

EXAMPLE 1

This example illustrates the graft copolymerization of styrene and an anionic prepolymer.

A water-jacketed, one-liter resin kettle is fitted with a stirrer, a thermometer, a condenser and three addition funnels. One funnel is charged with a solution of 97.5 grams acrylamide dissolved in 390 grams distilled water, the second funnel is charged with a solution of 2.5 grams of acrylic acid dissolved in 10 grams distilled water, and the third funnel is charged with 2.5 grams of ammonium persulfate dissolved in 47.5 grams distilled water. The resin kettle is charged with 117 grams distilled water and heated to 85°-87° C. under nitrogen sparge. The contents of the three funnels are added, dropwise, to the resin kettle over a period of 2¾ hours to provide a prepolymer solution. The prepolymer is a 97.5% acrylamide and 2.5% acrylic acid copolymer. When measured as a 1% solution in 1 M NaCl at 25° C. (1 M NaCl, 1%, 25° C.), the prepolymer has an RSV of 0.29. The prepolymer solution has a solids content of 15.8% by weight. The prepolymer is diluted with distilled water to a 10% solids content.

A water-jacketed, one-liter resin kettle is fitted with a stirrer, a thermometer, a condenser and two addition funnels. The kettle is charged with 163 grams of the above 10% prepolymer solution and 326 grams distilled water. One funnel is charged with 327 grams styrene and the other with 8.6 grams ammonium persulfate dissolved in 34.5 grams distilled water. The kettle contents are heated to 85° C. by circulating hot water in the jacket. The contents of the two funnels are added, dropwise, to the resin kettle over a period of 2½ hours. After addition is complete, the contents of the resin kettle are stirred for 15 minutes at 89°-91° C., followed by cooling to room temperature. The resulting latex is filtered through a 100-mesh sieve. The resulting latex contains a small amount of aggregate, and, to break up the aggregate, the latex is passed through a hand homogenizer. The latex has a solids content of 41% and the particles have a size of 0.6 micron. (Particle size is estimated from turbidity readings according to the method of A. B. Loebel (Official Digest, 200, February, 1959))

EXAMPLE 2

A latex is prepared in accordance with Example 1 except that the prepolymer used is a 90% acrylamide-10% acrylic acid copolymer haing an RSV of 0.44 (0.1 M NaCl, 1%, 25° C.). The latex has a solids content of 41.1%. The particles have a particle size of 0.62 micron (determined in the same manner as described in Example 1).

EXAMPLE 3

A water-jacketed, one-liter resin kettle is fitted with a stirrer, a thermometer, a condenser and three additional funnels. One funnel is charged with a solution of 90 grams of acrylamide dissolved in 360 grams of distilled water, the second funnel is chared with a solution of 10 grams of acrylic acid in 40 grams of distilled water, and the third funnel is charged with 3.75 grams of ammonium persulfate dissolved in 71 grams of distilled water. The resin kettle is charged with 195 grams distilled water and heated to 86°-89° C. under nitrogen sparge. The contents of the three funnels are added, dropwise, to the resin kettle over a period of 2 hours, followed by heating the reaction mass at 88.5°-90° C. for 15 minutes. The copolymer solution is cooled to room temperature. The RSV of the copolymer is 0.38 (1 M NaCl, 1%, 25° C.). The total solids are 14.2%. This prepolymer is diluted with distilled water to 10% solids content.

A water-jacketed, two-liter resin kettle is fitted with a stirrer, a thermometer, condenser and two addition funnels. The kettle is charged with 108.8 grams of the above 10% prepolymer solution and 217 grams distilled water. One funnel is charged with 218 grams of styrene and the other with 5.7 grams of ammonium persulfate dissolved in 23 grams of distilled water. The kettle contents are heated to 86.5° C. by circulating hot water through the jacket. The contents of the two funnels are added, dropwise, to the resin kettle over a period of 2½ hours. After addition is complete, the contents of the resin kettle are stirred for 15 minutes at 88°-90° C., followed by cooling to room temperature. The resulting latex is filtered through a 100 mesh sieve. No grit is isolated. The resultant latex has a solids content of 41.5% and a particle size of 0.7 micron (method described in Example 1).

EXAMPLE 4

A portion of the latex prepared in Example 3 is treated with glyoxal as follows: 180.8 grams of the latex is placed into a beaker. Glyoxal, 12.6 grams of a 40% aqueous solution (5.02 grams glyoxal), is added. The resultant pH is 1.8 and total solids are 41.4%. Reaction with glyoxal is carried out by taking 100 grams of the above latex-glyoxal mixture, adjusting the pH from 1.8 to 8–8.5 with 5 M NaOH, stirring for 15 minutes, diluting to 10% solids and adjusting the pH to about 2 with concentrated sulfuric acid.

EXAMPLE 5

This example illustrates the preparation of a cross-linked graft copolymer using divinylbenzene as cross-linking agent.

A water-jacketed, one-liter resin kettle is fitted with a stirrer, a thermometer, a condenser and two addition funnels. The kettle is charged with 1854 grams of a prepolymer solution and 3685 grams distilled water. The prepolymer solution is an aqueous solution of a 97.5% acrylamide-2.5% acrylic acid copolymer. The solution contains 10% by weight of the prepolymer and the prepolymer has an RSV of 0.39 (1 M NaCl, 1%, 25° C.). One funnel is charged with 3532 grams styrene and 176.6 grams of divinylbenzene. The second funnel is charged with a solution of 97.4 grams ammonium persulfate dissolved in 390 grams distilled water. The kettle contents are heated to about 92°–94° C. under a nitrogen blanket. The contents of each of the two funnels are added, dropwise, to the kettle over a period of four hours. The latex is stirred for fifteen minutes after these additions are complete and then filtered through a 100 mesh screen. This cross-linked latex has a solids content of 40%. Particle size is about 0.7 micron. (Particle size is estimated by the method described in Example 1.)

EXAMPLES 6–11

The following examples illustrate the preparation of crosslinked graft copolymers using ethylene glycol dimethacrylate, 1,3-butylene glycol dimethacrylate, 1,6-hexanediol dimethacrylate, polyethylene glycol dimethacrylate, polypropylene glycol dimethacrylate and diallyl phthalate as the crosslinking agent.

A crosslinked graft copolymer is prepared as described in Example 5 using the reactants and conditions shown in Table I. The two pH values for each example represent the pH of the reaction product (e.g., 2.2 for Example 6) and an adjusted pH of the product after addition of 5 M NaOH (e.g., 5.2 in Example 6).

TABLE I

| Example No. | Water cc. | Kettle Charge Poly(Acrylamide-co-Acrylic Acid) (a) grams | Styrene grams | Comonomer Crosslinker | Wt. g. | Ammonium Persulfate (b) grams | Temp. °C. | Time Hrs. | pH (c) | Total Solids % | Particle Size (d) microns |
|---|---|---|---|---|---|---|---|---|---|---|---|
| 6 | 227 | 11.3 | 218 | Ethylene glycol dimethacrylate | 8.7 | 5.95 | 87–91 | 2.9 | 2.2– | 39.0 | 0.83 |
| 7 | 226 | 11.2 | 218 | 1,3-butylene glycol dimethacrylate | 6.54 | 5.9 | 86.5–95 | 2.5 | 2.1–5.5 | 40.3 | 0.77 |
| 8 | 226 | 11.2 | 218 | Diallyl phthalate | 6.54 | 5.9 | 86–94 | 2.4 | 2.2–5.7 | 41.3 | 0.7 |
| 9 | 226 | 11.2 | 218 | 1,6-hexanediol dimethacrylate | 6.54 | 5.9 | 86–95 | 2.5 | 2.1–5.4 | 40.3 | 0.72 |
| 10 | 226 | 11.2 | 218 | Polyethylene glycol dimethacrylate | 6.54 | 5.9 | 87–95 | 2.5 | 2.0–5.2 | 40.2 | 0.68 |
| 11 | 226 | 11.2 | 218 | Polypropylene glycol dimethacrylate | 6.54 | 5.9 | 87–95 | 2.5 | 2.0–5.6 | 40.0 | 0.73 |

(a) Added as 10% solution RSV = 0.40 (1 M NaCl, 1%, 25° C.)
(b) Added as 20% solution
(c) Adjusted with 5 M NaOH
(d) Determined by absorbance method

EXAMPLE 12

This example illustrates a graft copolymerization of styrene and a cationic prepolymer.

A water-jacketed resin kettle equipped with a thermometer, a stirrer, a condenser and three addition funnels is charged with 87.0 grams of distilled water. The funnels are charged with: (1) 71.25 grams acrylamide (1.0 mole) in 166.0 grams distilled water; (2) 3.75 grams dimethyldiallylammonium chloride (0.023 mole) in 8.75 grams distilled water; and (3) 1.88 grams ammonium persulfate (0.008 mole) in 35.6 grams distilled water. The kettle contents are heated to 85°–89° C., and the contents of the three funnels are added, dropwise, over a period of 3 hours. After heating for an additional fifteen minutes, the solution is cooled to room temperature. The product solution contains 21.9% solids and has an RSV of 0.32 (1 M NaCl, 1%, 25° C.).

A water-jacketed resin kettle fitted with a thermometer, a stirrer, a condenser and three addition funnels is charged with 493.0 grams of distilled water and 54.4 grams of a 10% solids solution of the above copolymer (5.44 grams dry copolymer). The funnels are charged with: (1) 164.0 grams of a 10% total solids solution of the above copolymer (16.4 grams dry copolymer); (2) 218.0 grams styrene; and (3) 6.0 grams ammonium persulfate in 24.2 grams distilled water. The kettle contents are stirred and heated to 88° C. The contents of the three funnels are added over a period of 3 hours as the kettle temperature is maintained at 88°–93° C. After heating for an additional fifteen minutes, the product is cooled to room temperature. The product is a white latex containing 25.2% solids. Approximately half of the latex is dialyzed using a 48 A regenerated cellulose membrane to remove unreacted water-soluble prepolymer.

EXAMPLE 13

240.0 Grams of the latex prepared in Example 12 is placed in a reaction kettle and the pH adjusted from 4.2 to 9.1 with 0.9 ml. of 1 M sodium hydroxide solution.

Glyoxal (16.2 grams of a 40% aqueous solution, 0.112 mole) is added, and the pH adjusted from 6.2 to 9.0 with 0.8 ml. of 1 M sodium hydroxide solution. Water (56 ml.) is added to reduce the reaction solids. The mixture is heated for 4 hours at 50° C. and the pH is lowered to 2.0 with 0.5 ml. of a concentrated hydrochloric acid. The final product contains 18.2% solids.

EXAMPLE 14

This example illustrates the graft copolymerization of styrene and a cationic prepolymer.

Water (430 g.) and 10.88 g. (added as a 10% aqueous solution) of an acrylamide-dimethyldiallylammonium chloride copolymer (75% acrylamide) are placed in a reaction kettle and heated to 86° C. Additional acrylamide-dimethyldiallylammonium chloride copolymer (10.88 g. as 10% aqueous solution), 436 g. styrene, and ammonium persulfate (12 g. in 48.4 cc. water) are added simultaneously over a period of 2.5 hours. After a 15 minute post reaction period of stirring and maintaining the temperature at 87° C., the latex is cooled to room temperature.

The latex is filtered through a 100 mesh sieve. The latex has particle size of 0.9 microns and 41.4% total solid.

EXAMPLE 15

This example illustrates the graft copolymerization of acrylonitrile and an anionic prepolymer.

493 cc. distilled water and 218 grams of a 10% solution of an acrylamide-acrylic acid copolymer (33% acrylamide by weight) are placed into a reaction kettle and heated to 67°-68° C. Ammonium persulfate (6 grams in 24.2 cc. water) and 218 grams acrylonitrile are added dropwise over a period of about 2.5 hours. The latex produced is slightly yellow, slightly viscous, contains 24.8% total solids and has a particle size of 0.65$\mu$.

EXAMPLE 16

The example illustrates the graft copolymerization of methyl methacrylate and a cationic prepolymer.

Water (134 cc.) and an acrylamide-diallyldimethylammonium chloride copolymer (75% acrylamide by weight; 54.4 grams of a 10% solution) are placed into a reaction vessel and heated to 85° C. Methyl methacrylate (218 grams), ammonium persulfate (6 grams in 24.2 cc. water) and additional acrylamide-diallyldimethylammonium chloride copolymer (164 grams of a 10% solution) are added simultaneously over a period of about 2.5 hours. The final latex is filtered through a 100 mesh sieve yielding only a trace of grit. The latex has 40.7% total solids and a particle size of 0.71$\mu$.

EXAMPLE 17

This example illustrates the graft copolymerization of styrene and a nonionic prepolymer.

Water (506 cc.) and 2.72 g. polyvinyl alcohol (Vinol 207 sold by Air Products) are placed in a reaction kettle and heated to 80°-81° C. Styrene (218 g.) and ammonium persulfate (5.5 g. dissolved in 22 cc. water) are added over a period of 2.5 hours followed by 15 minutes of stirring at 81°-82° C.

The final product is filtered through a 100 mesh sieve removing only a trace of grit. The latex is aggregated but homogenization gives a uniform product. Total solids is 29.9% and the particle size is about 0.56 microns (measured by absorbance method).

EXAMPLE 18

This example illustrates the process of double coating paper by first applying a clay base coat to the surface of the paper followed by overcoating the clay basecoat with an organic pigment.

Twenty-five sheets of 50 lb. per 3000 sq. ft. coating grade base stock are coated with a clay base coat on a Time-Life trailing blade coater at 5 lbs./3000 ft.$^2$. The clay base coat has the following formulation and properties:

| | |
|---|---|
| Hydrafine** clay (70%)* | 428.6 grams |
| CMC*** (3%)* | 30 grams |
| Polyvinyl acetate binder (47.7%) | 125.8 g. |
| Initial pH | 4.8 |
| Concentrated $NH_4OH$ (drops) | 45 |
| Final pH | 8.5 |
| Brookfield viscosity | |
| 10 r.p.m. | 6000 cps. |
| 100 r.p.m. | 996 cps. |
| Hi-Shear Viscosity | |
| 1100 r.p.m. | 111 cps. |
| 2200 r.p.m. | 165 cps. |
| % Total Solids | 61.7 |

*Indicates weight percent of component in water.
**Trademark of J.M. Huber Corporation
***Sodium carboxymethyl cellulose (degree of substitution, about 0.9)

The sheets are dried in a laboratory oven at 100° C. for 45 seconds. The clay base coat composition is then diluted to about 56% solids and applied to several sheets as an overcoat with the Time-Life coater at 3.8 lbs./3000 ft.$^2$. These sheets are designated as controls.

Organic pigment coating colors are overcoated in a similar manner. The organic pigment used in overcoat A is a graft copolymer of styrene and an acrylamide-acrylic acid copolymer (90% acrylamide-10% acrylic acid; 0.5$\mu$) prepared as in Example 2. The same graft copolymer modified by glyoxal (1:2 amide:glyoxal mole ratio) is used in overcoat B.

| | Overcoat A | Overcoat B |
|---|---|---|
| Organic pigment (40% total solids) | 184.7 g. | 184.7 g. |
| CMC*** (3%) | 15 g. | 15 g. |
| Polyvinyl acetate binder (47.2%) | 62.9 g. | 62.9 g. |
| Initial pH | 2.4 | 2.4 |
| Concentrated $NH_4OH$ (drops) | 55 | 250 |
| Final pH | 7.6 | 7.6 |
| Brookfield Viscosity | | |
| 10 r.p.m. | 1000 cps. | 536 cps. |
| 100 r.p.m. | 304 cps. | 197 cps. |
| Hi-Shear Viscosity | | |
| 1100 r.p.m. | 49 cps. | 52 cps. |
| 2200 r.p.m. | 43 cps. | 42 cps. |
| % Total Solids | 39.9 | 40.0 |

***Sodium carboxymethyl cellulose (degree of substitution, about 0.9)

Overcoating compositions A and B are coated over the clay base coat at 1.9 lbs. and 1.3 lbs./3000 ft.$^2$, respectively. The sheets are calendered at 71° C. and 750 pli with the following results. Gloss was measured by TAPPI method T-480. Gloss values are those measured after passing the coated paper through the nip the indicated number of times.

| | Gloss Development | | |
|---|---|---|---|
| | 2 nips | 3 nips | 4 nips |
| Overcoat A | 74 | 76 | 79 |
| Overcoat B | 68 | 69 | 77 |

-continued

| | Gloss Development | | |
|---|---|---|---|
| | 2 nips | 3 nips | 4 nips |
| Control | 64 | 69 | 74 |

EXAMPLE 19

A clay base coat having the following formulation is applied to the base stock used in Example 18 with a Meyer rod at 4.5 lbs./3000 ft.$^2$.

| | | |
|---|---|---|
| Hydrafine** clay (70%) | 535.7 | g. |
| CMC***(3%) | 30 | g. |
| Polyviinyl acetate binder (44.5%) | 165 | g. |
| $H_2O$ | 75 | g. |
| Initial pH | 4.5 | |
| Concentrated $NH_4OH$ (drops) | 100 | |
| Final pH | 9.0 | |
| Brookfield viscosity | | |
| 10 r.p.m. | 9960 | cps. |
| 100 r.p.m. | 1752 | cps. |
| Hi-Shear Viscosity | | |
| 1100 r.p.m. | 131 | cps. |
| 2200 r.p.m. | 82 | cps. |
| Total Solids (%) | 55.8 | |

**Trademark of J. M. Huber Corporation
***Sodium carboxymethyl cellulose (degree of substitution, about 0.9)

While wet the sheets are transferred to a Time-Life coater. Some of the sheets are overcoated with a second clay coating using the composition described above diluted to 50.9% total solids. Other sheets are overcoated with the following formulation:

| | Overcoat C |
|---|---|
| Organic pigment- | |
| Graft copolymer of styrene with acrylamide-dimethyldiallylammonium chloride copolymer (75% acrylamide-25% dimethyldiallylammonium chloride prepared in Example 14, 41.4% total solids) | 99 g. |
| CMC*** (3%) | 4.1 g. |
| Polyvinyl acetate binder (44.5%) | 18.4 g. |
| Initial pH | 1.9 |
| Concentrated $NH_4OH$ (drops) | 35 |
| Final pH | 9.0 |
| Brookfield viscosity | |
| 10 r.p.m. | 300 cps. |
| 100 r.p.m. | 128 cps. |
| Hi-Shear Viscosity | |
| 1100 r.p.m. | 26 cps. |
| 2200 r.p.m. | 23 cps. |
| Total Solids (%) | 40.0 |
| Coating weight (lb./3000 ft.$^2$) | 1.4 |

***Sodium carboxymethyl cellulose (degree of substitution, about 0.9)

After application of the overcoat, the sheets are dried at 100° C. for 45 seconds, conditioned in a constant temperature and humidity room and calendered at 54° C. and 750 pli with the following results:

| | Gloss Development | | | |
|---|---|---|---|---|
| | 0 nips | 2 nips | 3 nips | 4 nips |
| Clay double coated control | 10 | 49 | 53 | 54 |
| Overcoat C | 26 | 64 | 69 | 70 |

EXAMPLE 20

Base stock as used in Example 18 is coated as described in Example 18 using the organic pigment prepared in Example 15 for the overcoat.

| | Basecoat | Overcoat D |
|---|---|---|
| Graft copolymer of acrylonitrile with acrylamide-acrylic acid copolymer (24.8% total solids) | — | 238.8 g. |
| Hydrafine** clay (70%) | 428.5 g. | — |
| CMC*** (3%) | 30.0 g. | 3.13 g. |
| Polyvinyl acetate binder (50.2%) | — | 24.9 g. |
| Butadiene-styrene copolymer rubber latex (50%) | 102.0 g. | — |
| $H_2O$ | 23.0 g. | — |
| Initial pH | 6.3 | 6.2 |
| Concentrated $NH_4OH$ (drops) | 17 | 22 |
| Final pH | 8.5 | 8.5 |
| Brookfield Viscosity | | |
| 10 r.p.m. | 4180 cps. | 180 cps. |
| 100 r.p.m. | 735 cps. | 68 cps. |
| Hi-Shear Viscosity | | |
| 1100 r.p.m. | 36 cps. | 40 cps. |
| 2200 r.p.m. | 34 cps. | 23 cps. |
| Total Solids (%) | 60.4 | 26.8 |
| Coating weight (lbs./3000 ft.$^2$) | | |
| Basecoat | 4.6 — | |
| Overcoat | — | 1.4 |

**Trademark of J. M. Huber Corporation
***Sodium carboxymethyl cellulose (degree of substitution, about 0.9)

The sheets are dried as in Example 18 and calendered.

| Test Results | | | | |
|---|---|---|---|---|
| | Gloss Development (71° C., 1500 pli) | | | |
| | 0 nips | 2 nips | 3 nips | 4 nips |
| Overcoat D | 25 | 71 | 74 | 75 |

EXAMPLE 21

Base stock as used in Example 18 is coated as described in Example 18 using the organic pigment prepared in Example 16 for the overcoat.

| | Basecoat | Overcoat E |
|---|---|---|
| Graft copolymer of methyl methacrylate with an acrylamide-diallyldimethylammonium chloride copolymer (40.7% total solids) | — | 122.9 g. |
| Hydrafine** clay (70%) | 535.7 g. | — |
| CMC*** (3%) | 30 g. | 5 g. |
| Polyvinyl acetate binder (47.2%) | 155.7 g. | 21.2 g. |
| $H_2O$ | 75 g | — |
| Initial pH | 4.9 | 3.7 |
| Concentrated $NH_4OH$ (drops) | 65 | 36 |
| Final pH | 9.1 | 9.1 |
| Brookfield Viscosity | | |
| 10 r.p.m. | 2400 cps. | 3200 cps. |
| 100 r.p.m. | 370 cps. | 880 cps. |
| Hi-Shear Viscosity | | |
| 1100 r.p.m. | 22 cps. | 49 cps. |
| 2200 r.p.m. | 23 cps. | 34 cps. |
| Total Solids (%) | 56 | 39.4 |
| Coating weight (lbs./3000 ft.$^2$) | | |
| Basecoat | 4.5 | — |
| Overcoat | 2.9 (e) | 1.6 |

(e) Basecoat is overcoated with second clay coating.
**Trademark of J. M. Huber Corporation
***Sodium carboxymethyl cellulose (degree of substitution, about 0.9)

The sheets are dried as in Example 18 and calendered.

| Test Results | | | | | |
|---|---|---|---|---|---|
| | Gloss Development (71° C., 1500 pli) | | | | |
| | 0 nips | 2 nips | 3 nips | 4 nips | 6 nips |
| Clay control coating | 13 | 47 | 51 | 56 | 63 |
| Overcoat E | 30 | 54 | 56 | 60 | 64 |

EXAMPLE 22

Base stock sheets as used in Example 18 are coated as described in Example 18. The organic pigment used as overcoat is that described in Example 17.

| | Basecoat | Overcoat F |
|---|---|---|
| Graft copolymer of styrene with poly(vinyl alcohol) (29.9% total solids) | — | 125 g. |
| Hydrafine** clay (70%) | 267.9 g. | — |
| CMC*** (3%) | 15.0 g. | 3.75 g. |
| Butadiene-styrene copolymer rubber latex (50%) | 73.6 g. | — |
| Polyvinyl acetate binder (47.8%) | — | 15.7 g. |
| $H_2O$ | 18.5 g. | — |
| Initial pH | 6.1 | 2.3 |
| Concentrated $NH_4OH$ (drops) | 13 | 12 |
| Final pH | 8.5 | 8.5 |
| Brookfield Viscosity | | |
| 10 rpm | 3260 cps. | 100 cps. |
| 100 rpm | 590 cps. | 53 cps. |
| Hi-Shear Viscosity | | |
| 1100 rpm | 39 cps. | 7 cps. |
| 2200 rpm | 38 cps. | 6 cps. |
| Total Solids (%) | 60 | 30.4 |
| Coating Weight (lbs./3000 ft.$^2$) | | |
| Basecoat | 4.5 | — |
| Overcoat | 1.6 (j) | 1.6 |

**Trademark of J. M. Huber Corporation
***Sodium carboxymethyl cellulose (degree of substitution about 0.9)
(j)Basecoat is overcoated with basecoat composition diluted to 40% solids as control.

| Test Results | | | | |
|---|---|---|---|---|
| | Gloss Development (71° C., 750 pli) | | | |
| | 0 nips | 2 nips | 3 nips | 4 nips |
| Clay control coating | 18 | 69 | 71 | 75 |
| Overcoat F | 27 | 76 | 77 | 80 |

EXAMPLE 23

Base stock sheets as used in Example 18 are coated as described in Example 18 using the formulations indicated in Table II. The organic pigments used as overcoats G-M are those described in Examples 5-11, respectively.

The sheets are dried as in Example 18 and calendered.

| Test Results | | | | |
|---|---|---|---|---|
| | Gloss Development (71° C., 750 pli) | | | |
| | 0 nips | 2 nips | 3 nips | 4 nips |
| Clay overcoat control | 19 | 66 | 68 | 71 |
| Overcoat G | 28 | 72 | 75 | 76 |
| Overcoat H(g) | 35 | 72 | 75 | 76 |
| Overcoat I(g) | 33 | 72 | 74 | 77 |
| Overcoat J | 31 | 73 | 75 | 77 |
| Overcoat K | 32 | 71 | 74 | 75 |
| Overcoat L | 34 | 70 | 74 | 75 |
| Overcoat M(h) | 32 | 73 | 76 | 77 |

(g)Very slight sticking to calendar at this temperature.
(h)Sticking to calendar under these operating conditions.

TABLE II

| | Basecoat | Overcoat G | Overcoat H | Overcoat I | Overcoat J | Overcoat K | Overcoat L | Overcoat M |
|---|---|---|---|---|---|---|---|---|
| Organic pigment dispersion | — | 190.8 g. (from Ex.5) | 192.3 g. (from Ex.6) | 186.1 g. (from Ex.7) | 181.6 g. (from Ex.8) | 186.1 g. (from Ex.9) | 186.6 (from Ex.10) | 187.5 g. (from Ex.11) |
| Hydrafine** clay | 535.7 g. | — | — | — | — | — | — | — |
| CMC*** (3%) | 30.0 g. | 7.5 g. | 7.5 g. | 7.5 g. | 7.5 g. | 7.5 g. | 7.5 g. | 7.5 g. |
| Polyvinyl acetate binder (47.8%) | — | 31.4 g. | 31.4 g. | 31.4 g. | 31.4 g. | 31.4 g. | 31.4 g. | 31.4 g. |
| copolymer rubber latex (50%) | 147.1 g. | — | — | — | — | — | — | — |
| $H_2O$ | 37.0 g. | 23 g. | — | 6.3 g. | 10.8 g. | 6.3 g. | 5.8 g. | 4.9 g. |
| Initial pH | 6.2 | 4.8 | 4.8 | 4.6 | 4.7 | 4.7 | 4.7 | 4.7 |
| Concentrated $NH_4OH$ (drops) | 29 | 12 | 11 | 12 | 12 | 12 | 11 | 11 |
| Final pH | 8.5 | 8.5 | 8.5 | 8.5 | 8.5 | 8.5 | 8.5 | 8.5 |
| Brookfield Viscosity | | | | | | | | |
| @10 r.p.m. | 3800 cps. | 1050 cps. | 640 cps. | 380 cps. | 300 cps. | 480 cps. | 880 cps. | 540 cps. |
| @100 r.p.m. | 600 cps. | 350 cps. | 184 cps. | 140 cps. | 112 cps. | 160 cps. | 260 cps. | 176 cps. |
| Hi-Shear Viscosity | | | | | | | | |
| @1100 r.p.m. | 42 cps. | 36 cps. | 24 cps. | 32 cps. | 24 cps. | 28 cps. | 33 cps. | 18 cps. |
| @2200 r.p.m. | 42 cps. | 27 cps. | 20 cps. | 26 cps. | 20 cps. | 24 cps. | 27 cps. | 17 cps. |
| Total Solids (%) | 60.0 | 35.0 | 39.0 | 38.6 | 38.4 | 39.2 | 39.0 | 39.2 |
| Coating Weight | | | | | | | | |
| Basecoat | 4.5 | — | — | — | — | — | — | — |
| Overcoat | 1.6(i) | 1.6 | 1.4 | 1.4 | 1.5 | 1.6 | 1.4 | 1.6 |

(i)Basecoat is overcoated with basecoat composition diluted to 40% as control.
**Trademark of J. M. Huber Corporation
***Sodium carboxymethyl cellulose (degree of substitution, about 0.9).

What I claim and desire to protect by Letters Patent is:

1. A paper coating process comprising:

A. applying to the surface of a paper substrate a first coating of a composition comprising an inorganic pigment and a binder; and B. applying onto the surface of said first coating a second coating of a composition comprising an organic pigment and a binder, said organic pigment being water-insoluble graft copolymer particles consisting essentially of the free radical catalyzed graft copolymerization product of (1) at least one ethylenically unsaturated monomer and (2) a water-soluble prepolymer, the prepolymer moiety of the graft copolymer particles being present on the surface of the particles, said monomer (1) being selected from the group consisting of methyl alpha-chloroacrylate, ethyl alpha-chloroacrylate, methyl methacrylate, isopropyl methacrylate, phenyl methacrylate, vinyl chloride, acrylonitrile, methacrylonitrile, and monomers having the formula

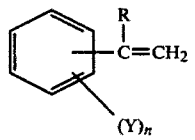

wherein R is hydrogen or methyl, Y is methyl or chlorine, and n is 0, 1, 2, or 3 and said prepolymer (2) being selected from the group consisting of:

a. anionic prepolymers prepared by the addition polymerization of a vinyl monomer or mixtures of vinyl monomers;

b. nonionic prepolymers prepared by the addition polymerization of a vinyl monomer or mixtures of vinyl monomers and;

c. cationic prepolymers prepared by the addition polymerization of (i) about 5 mole percent to about 95 mole percent of at least one cationic monomer selected from the group consisting of

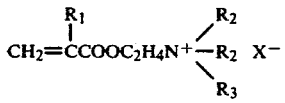

(I)

wherein $R_1$ is hydrogen or methyl, $R_2$ is hydrogen or a $C_1$–$C_4$ alkyl, $R_3$ is hydrogen, a $C_1$–$C_4$ alkyl,

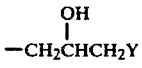

where Y is hydroxyl or halogen,

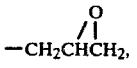

and $(CH_2CH_2O)_nH$ where n is an integer 1 or more and $X^-$ is an anion,

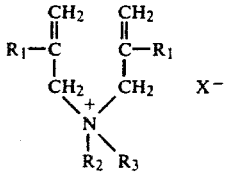

(II)

wherein $R_1$ is hydrogen or a $C_1$–$C_4$ alkyl, $R_2$ is hydrogen, alkyl or substituted alkyl, and $R_3$ and $X^-$ are as defined in formula (I),

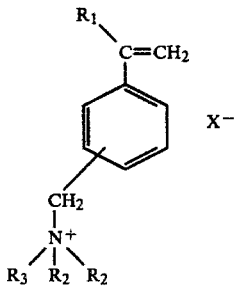

(III)

wherein $R_1$, $R_2$, $R_3$ and $X^-$ are as defined in formula (I),

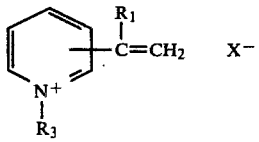

(IV)

wherein $R_1$, $R_3$ and $X^-$ are as defined in formula (I),

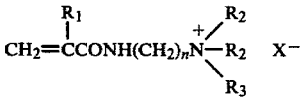

(V)

wherein $R_1$, $R_2$, $R_3$ and $X^-$ are as defined in formula (I), and n is an integer 1, 2 or 3 and

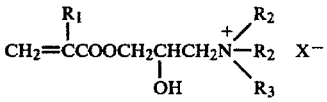

(VI)

wherein $R_1$, $R_2$, $R_3$ and $X^-$ are as defined in formula (I), and (ii) from about 95 mole percent to about 5 mole percent of at least one ethylenically unsaturated nonionic monomer selected from the group consisting of N-vinyl pyrrolidone, ethylenically unsaturated monomers having amide functionality, and ethylenically unsaturated monomers having hydroxyl functionality, the amount of prepolymer (2) employed in preparing the graft copolymer particles being from about 1 part to about 25 parts by weight for each 100 parts by weight of monomer (1) employed.

2. The process of claim 1 wherein the monomer (1) is styrene.

3. The process of claim 1 wherein there is employed in combination with monomer (1) a polyethylenically unsaturated monomer in an amount at least sufficient to provide cross-linked graft copolymer particles.

4. The process of claim 3 wherein the polyethylenically unsaturated monomer is selected from divinylbenzene; diallyl phthalate; ethylene glycol dimethacrylate; 1,3-butylene glycol dimethacrylate; 1,6-hexane diol dimethacrylate; polyethylene glycol dimethacrylate; polypropylene glycol dimethacrylate; trivinylbenzene; divinylnaphthalene; diallyl maleate; diallyl fumarate; trimethylol propane trimethacrylate; pentaerythritol tetraacrylate; and mixtures thereof.

5. The process of claim 4 wherein the monomer (1) is styrene, prepolymer (2) is a copolymer of acrylamide and acrylic acid, and the polyethylenically unsaturated monomer is divinylbenzene.

6. The process of claim 4 wherein the monomer (1) is styrene, prepolymer (2) is a copolymer of acrylamide and acrylic acid, and the polyethylenically unsaturated monomer is ethylene glycol dimethacrylate.

7. The process of claim 4 wherein the monomer (1) is styrene, prepolymer (2) is a copolymer of acrylamide and acrylic acid, and the polyethylenically unsaturated monomer is 1,3-butylene glycol dimethacrylate.

8. The process of claim 4 wherein the monomer (1) is styrene, prepolymer (2) is a copolymer of acrylamide and acrylic acid, and the polyethylenically unsaturated monomer is diallyl phthalate.

9. The process of claim 1 wherein monomer (1) is styrene and (i) of prepolymer (2) is the monomer of formula (II) and (ii) of prepolymer (2) is acrylamide.

10. The process of claim 1 wherein monomer (1) is styrene and prepolymer (2) is a copolymer of acrylamide and acrylic acid.

11. The process of claim 1 wherein monomer (1) is styrene and prepolymer (2) is poly(vinyl alcohol).

12. The process of claim 1 wherein the prepolymer moiety of the graft copolymer particles has chemically bonded thereto a cellulose reactive group.

13. The process of claim 12 wherein the cellulose reactive group is an aldehyde.

14. A coated paper comprising a paper substrate having adhered to at least one surface thereof a first coating composition comprised of an inorganic pigment and a binder and having adhered to said first coating composition a second coating composition comprised of a binder and an organic pigment, said organic pigment being water-insoluble graft copolymer particles consisting essentially of the free radical catalyzed graft copolymerization product of (1) at least one ethylenically unsaturated monomer and (2) a water-soluble prepolymer, the prepolymer moiety of the graft copolymer particles being present on the surface of the particles, said monomer (1) being selected from the group consisting of methyl alpha-chloroacrylate, ethyl alpha-chloroacrylate, methyl methacrylate, isopropyl methacrylate, phenyl methacrylate, vinyl chloride, acrylonitrile, methacrylonitrile, and monomers having the formula

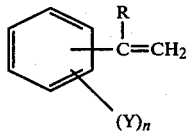

wherein R is hydrogen or methyl, Y is methyl or chlorine, and n is 0, 1, 2, or 3 and said prepolymer (2) being selected from the group consisting of:

a. anionic prepolymers prepared by the addition polymerization of a vinyl monomer or mixtures of vinyl monomers;
b. nonionic prepolymers prepared by the addition polymerization of a vinyl monomer or mixtures of vinyl monomers and;
c. cationic prepolymers prepared by the addition polymerization of
   (i) about 5 mole percent to about 95 mole percent of at least one cationic monomer selected from the group consisting of

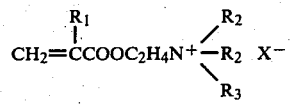

(I)

wherein $R_1$ is hydrogen or methyl, $R_2$ is hydrogen or a $C_1$–$C_4$ alkyl, $R_3$ is hydrogen, a $C_1$–$C_4$ alkyl,

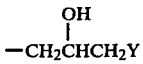

where Y is hydroxyl or halogen,

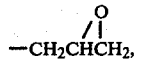

and $(-CH_2CH_2O)_nH$ where n is an integer 1 or more and $X^-$ is an anion,

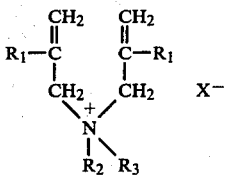

(II)

wherein $R_1$ is hydrogen or a $C_1$–$C_4$ alkyl, $R_2$ is hydrogen, alkyl or substituted alkyl, and $R_3$ and $X^-$ are as defined in formula (I),

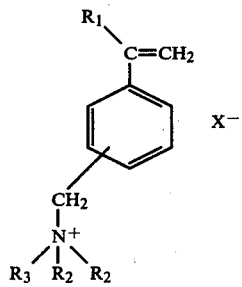

(III)

wherein $R_1$, $R_2$, $R_3$ and $X^-$ are as defined in formula (I),

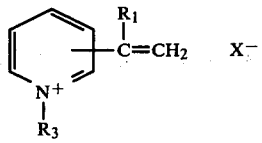

(IV)

wherein $R_1$, $R_3$ and $X^-$ are as defined in formula (I),

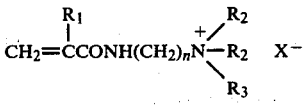

(V)

wherein $R_1$, $R_2$, $R_3$ and $X^-$ are as defined in formula (I), and n is an integer 1, 2 or 3 and

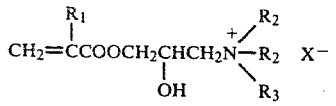

(VI)

wherein $R_1$, $R_2$, $R_3$ and $X^-$ are as defined in formula (I), and (ii) from about 95 mole percent to about 5 mole percent of at least one ethylenically unsaturated nonionic monomer selected from the group consisting of N-vinyl pyrrolidone, ethylenically unsaturated monomers having amide functionality, and ethylenically unsaturated monomers having hydroxyl functionality, the amount of prepolymer (2) employed in preparing the graft copolymer particles being from about 1 part to about 25 parts by weight for each 100 parts by weight of monomer (1) employed.

15. The coated paper of claim 14 wherein the monomer (1) is styrene.

16. The coated paper of claim 14 wherein there is employed in combination with monomer (1) a polyethylenically unsaturated monomer in an amount at least sufficient to provide cross-linked graft copolymer particles.

17. The coated paper of claim 16 wherein the polyethylenically unsaturated monomer is selected from divinylbenzene; diallyl phthalate; ethylene glycol dimethacrylate; 1,3-butylene glycol dimethacrylate; 1,6-hexane diol dimethacrylate; polyethylene glycol dimethacrylate; polypropylene glycol dimethacrylate; trivinylbenzene; divinylnaphthalene; diallyl maleate, diallyl fumarate; trimethylol propane trimethacrylate; pentaerythritol tetraacrylate; and mixtures thereof.

18. The coated paper of claim 16 wherein the monomer (1) is styrene, prepolymer (2) is a copolymer of acrylamide and acrylic acid, and the polyethylenically unsaturated monomer is divinylbenzene.

19. The coated paper of claim 16 wherein the monomer (1) is styrene, prepolymer (2) is a copolymer of acrylamide and acrylic acid, and the polyethylenically unsaturated monomer is ethylene glycol dimethacrylate.

20. The coated paper of claim 16 wherein the monomer (1) is styrene, prepolymer (2) is a copolymer of acrylamide and acrylic acid, and the polyethylenically unsaturated monomer is 1,3-butylene glycol dimethacrylate.

21. The coated paper of claim 16 wherein the monomer (1) is styrene, prepolymer (2) is a copolymer of acrylamide and acrylic acid, and the polyethylenically unsaturated monomer is diallyl phthalate.

22. The coated paper of claim 14 wherein monomer (1) is styrene and (i) of prepolymer (2) is the monomer of formula (II) and (ii) of prepolymer (2) is acrylamide.

23. The coated paper of claim 14 wherein monomer (1) is styrene and prepolymer (2) is a copolymer of acrylamide and acrylic acid.

24. The coated paper of claim 14 wherein monomer (1) is styrene and prepolymer (2) is poly(vinyl alcohol).

25. The coated paper of claim 14 wherein the prepolymer moiety of the graft copolymer particles has chemically bonded thereto a cellulose reactive group.

26. The coated paper of claim 25 wherein the cellulose reactive group is an aldehyde.

* * * * *